US012209341B2

(12) United States Patent
Moore et al.

(10) Patent No.: US 12,209,341 B2
(45) Date of Patent: Jan. 28, 2025

(54) SMART MOTOR CONTROLLED QUILTING MACHINE

(71) Applicant: APQS, INC., Carroll, IA (US)

(72) Inventors: Mike Moore, Carroll, IA (US); Nathaniel Moore, Carroll, IA (US)

(73) Assignee: APQS, INC., Carroll, IA (US)

( * ) Notice: Subject to any disclaimer, the term of this patent is extended or adjusted under 35 U.S.C. 154(b) by 0 days.

(21) Appl. No.: 18/061,771

(22) Filed: Dec. 5, 2022

(65) Prior Publication Data

US 2024/0183091 A1 Jun. 6, 2024

(51) Int. Cl.

| | |
|---|---|
| ***D05B 69/28*** | (2006.01) |
| ***D05B 11/00*** | (2006.01) |
| ***D05B 19/14*** | (2006.01) |
| ***D05B 69/12*** | (2006.01) |

(52) U.S. Cl.
CPC ..... *D05B 69/28* (2013.01); *D05B 11/00* (2013.01); *D05B 19/14* (2013.01); *D05B 69/12* (2013.01)

(58) Field of Classification Search
CPC ..... D05B 19/14; D05B 68/12; D05B 69/28; D05B 11/00; D05B 69/24; D05B 69/10
See application file for complete search history.

(56) References Cited

U.S. PATENT DOCUMENTS

| | | | | |
|---|---|---|---|---|
| 3,515,080 A | | 6/1970 | Ramsey | |
| 5,458,075 A | | 10/1995 | Tice et al. | |
| 5,832,849 A | * | 11/1998 | Kaetterhenry | D05B 11/00 112/475.08 |
| 5,839,382 A | * | 11/1998 | Tice | D05B 69/12 112/155 |
| 6,079,341 A | * | 6/2000 | Resta | D05B 11/00 112/117 |
| 7,918,170 B2 | | 4/2011 | Myers et al. | |
| 10,982,367 B2 | * | 4/2021 | Konzak | D05B 11/00 |
| 2002/0104468 A1 | | 8/2002 | Myers et al. | |

FOREIGN PATENT DOCUMENTS

| | | | |
|---|---|---|---|
| CN | 204417809 U | * | 6/2015 |
| CN | 106319782 B | * | 4/2020 |

* cited by examiner

*Primary Examiner* — Danny Worrell
(74) *Attorney, Agent, or Firm* — McKee, Voorhees & Sease, PLC

(57) ABSTRACT

A longarm quilting machine having a frame with an upper arm and a lower arm. A needle bar drive mechanism configured to be combined with a needle is combined with a portion of the upper arm and a bobbin hook assembly configured to be combined with a bobbin is combined with a portion of the lower arm. A needle motor is operatively combined with the needle bar drive mechanism and configured to provide torque to the needle bar drive mechanism to cause the needle to move up and down. A bobbin motor is operatively combined with the bobbin hook assembly and configured to provide torque to the bobbin hook assembly causing the bobbin to rotate beneath the needle. A controller is in communication with the needle motor and the bobbin motor to determine whether the components are synchronized and run a synchronization mode upon the occurrence of certain predetermined events.

15 Claims, 6 Drawing Sheets

SMART MOTOR CONTROLLED QUILTING MACHINE

BACKGROUND

Longarm quilting is the process by which a longarm quilting machine is used to sew together a quilt top, quilt batting, and quilt backing into a finished quilt. The quilting stitch adds depth and a secondary design to the quilt top. The longarm quilting machine was developed because stitching together the three layers by hand is difficult and takes a long time. Sewing machines are not well adapted for quilting because sewing machines have a small throat which cannot effectively stitch a large, bulky quilt. Further, sewing machine heads are stationary requiring the user to move the quilt under the stitching assembly, which is difficult with large quilts.

A longarming system typically includes an industrial length quilting machine having a quilting head, a frame, a table, and several rollers on which the fabric layers and batting are attached. The quilt's layers are attached to different parts of the table or frame. The quilting machine is mounted to the frame to be movable in two dimensions relative to the stationary quilt/frame.

Precision timing is required between the needle and bobbin to ensure the components work together to make the stitch. A traditional quilting machine is shown in in FIG. 1 wherein a single electric motor 50 mechanically drives the motion of the needle and the bobbin using a series of drive shafts 53, 55, belts 52, and linkages 54, 56. The needle drive shaft 53 extends through the upper arm 18 and is configured to be rotated by the motor 50 to drive the components in the needle bar drive mechanism 19. The bobbin drive shaft 55 extends through the lower arm 21 and is configured to be rotated by the motor 50 to drive the components in the bobbin hook assembly 26.

Several disadvantages result from mechanically linking the motor 50 to the needle and bobbin. One disadvantage is that the drive shafts 53, 55, belts 52, and linkages 54, 56 tend to vibrate and their movement can cause significant noise levels during operation. Further, the mass of the mechanical components requires significant acceleration/deceleration times. Still further, one of the most significant disadvantages of mechanically linking the components of a quilting machine relates to the needle and bobbin becoming unsynchronized. The relatively large number of mechanically linked components provides increased opportunity for the assembly to become unsynchronized. Once unsynchronized, manually adjusting the timing/synchronization of the components can be very difficult using conventional tools. Often a quilter will require the help of a professional or the manufacturer to re-synchronize the timing of the components.

There is therefore a need for an improved quilting machine that overcomes these another other disadvantages with the existing technology.

SUMMARY

One aspect of the invention relates to a longarm quilting machine having a frame with an upper arm and a lower arm, each of the upper arm and the lower arm having a cavity therein and a distal portion. A needle bar drive mechanism configured to be combined with a needle is combined with a portion of the upper arm and a bobbin hook assembly configured to be combined with a bobbin is combined with a portion of the lower arm. A needle motor is operatively combined with the needle bar drive mechanism and configured to provide torque to the needle bar drive mechanism to cause the needle to move up and down. A bobbin motor is operatively combined with the bobbin hook assembly and configured to provide torque to the bobbin hook assembly to cause the bobbin to rotate beneath the needle. In one embodiment, the needle motor is positioned near the distal portion of the upper arm and the bobbin motor is positioned near the distal portion of the lower arm. The needle motor and the bobbin motor are smart motors and may be servo motors, stepper motors, or hybrid servo/stepper motors. In one embodiment the motors are hybrid servo-stepper motors configured to receive a command pulse stream instructing the movement of each motor. The motors may be open loop such that they do not communicate with each other or they may be closed loop such that they do communicate with each other. In one embodiment an electronic controller such as a circuit, processor, or servo controller, is in communication with the needle motor and the bobbin motor. The electronic controller uses position feedback information provided by the motors or by a position sensor in communication with the electronic controller to monitor and control the rotational position of each motor. In one embodiment, the position information is used to determine whether the needle and the bobbin are aligned relative to each other (synchronized). If the system determines the needle and bobbin are out of synchronization, then the electronic controller instructs the motors to stop. As explained below, the machine may then proceed to a synchronization mode to re-synchronize the needle and the bobbin.

Another aspect of the invention relates to a computer-implemented method of synchronizing the needle motor and the bobbin motor using a synchronization mode logic path. In some embodiments the controller is configured to use motor positional information to synchronize the needle motor and the bobbin motor upon the occurrence of one or more predetermined events. Such events may include turning the power ON, pausing quilting operation for a predetermined amount of time, or determining that the needle motor and the bobbin motor are not synchronized. The controller monitors the operation of the machine to determine the occurrence of one of the predetermined events. Upon the occurrence of a predetermined event, the controller determines the position of the needle motor to ensure the needle is raised out of the bobbin hook assembly so it will not be damaged by movement of the bobbin during the synchronization process. If the needle is safe, the controller sends a command to rotate the bobbin motor to a predetermined home position and then sends a command to rotate the needle motor to a corresponding predetermined home position. With each motor in its home position, the motors are synchronized and ready for operation. If the controller determines the needle is not raised out of the bobbin hook assembly at the beginning of the synchronization process, then the controller first sends a command to rotate the needle motor to a predetermined home position and then the bobbin motor to move the bobbin to the corresponding home position to ensure the needle and bobbin are synchronized.

Another aspect of the invention relates to a method of using the quilting machine described above. The method includes turning the machine ON to power the controller and the motors. Instructing the controller to align the needle and the bobbin relative to each other by determining the position of the needle motor to ensure the needle is raised out of the bobbin hook assembly. If the needle is safe, sending the controller a command to rotate the bobbin motor to a predetermined home position and then sending a command to rotate the needle motor to the corresponding home position to synchronize the needle and bobbin. If the controller determines the needle is not raised out of the bobbin hook assembly at the beginning of the synchronization process, then first sending the controller a command to rotate the needle motor to a predetermined home position and then sending a command to the bobbin motor to move the bobbin to a corresponding predetermined home position to ensure the needle and bobbin are synchronized.

DETAILED DESCRIPTION

Figure 1:
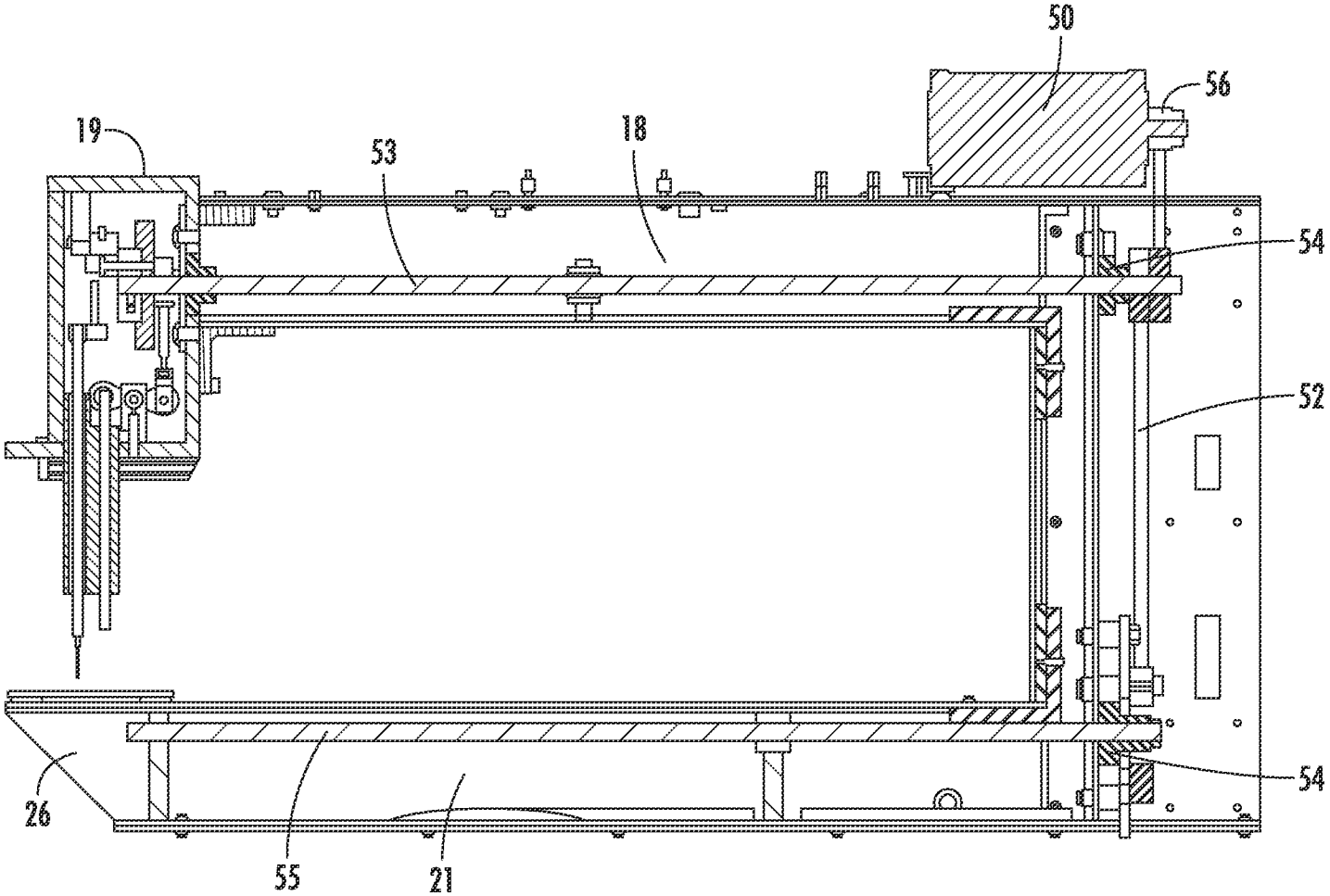
FIG. 1 PRIOR ART
FIG. 1 is a section view of an existing long arm quilting machine showing the mechanical connection of the components.
Figure 2:
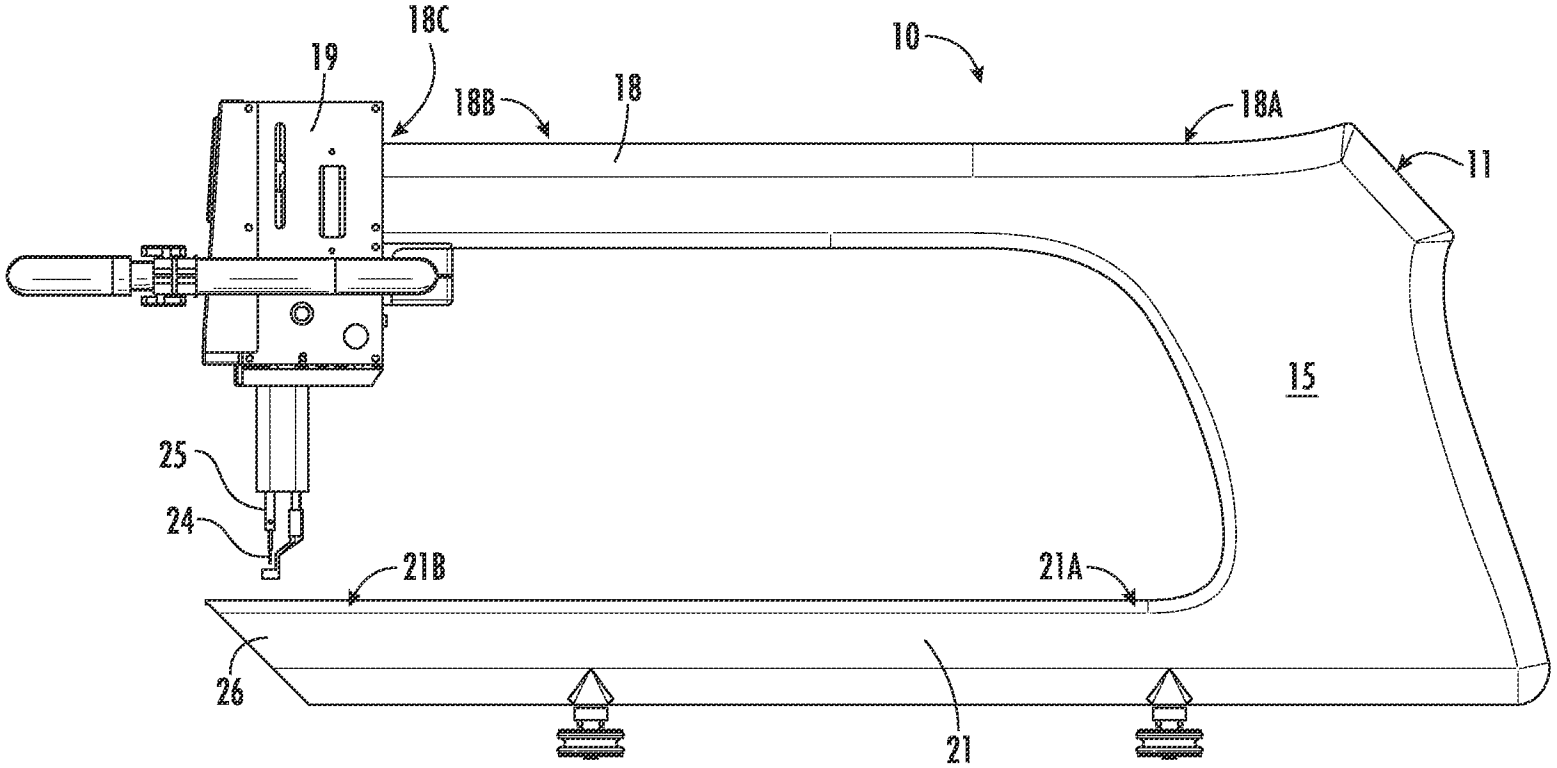
FIG. 2 is a side view of an embodiment of the quilting machine.

The invention generally relates to a longarm quilting machine 10. FIG. 2 shows the longarm quilting machine 10 having a frame 11 with an upper arm 18 and a lower arm 21. The arms 18, 21 are connected by an intermediate portion 15. In the embodiment shown, the upper arm 18 and the lower arm 21 have a cavity therein configured to receive components of the machine 10 as described below in more detail. The upper arm 18 has a proximal portion 18A near the intermediate portion 15 of the frame 11 and a distal portion 18B opposite the intermediate portion 15 and near an end 18C. Similarly, the lower arm 21 has a proximal portion 21A near the intermediate portion 15 and a distal portion 21B opposite the intermediate portion 15 and near an end 21C. A needle bar drive mechanism 19 having a needle carrier 25 configured to be combined with a needle 24. The needle bar drive mechanism 19 is combined with the end 18C of the upper arm 18. A bobbin hook assembly 26 is configured to be combined with a bobbin 17 and combined with the end 21C of the lower arm 21.

Each arm 18, 21 has a length extending from its connection with the intermediate portion 15 to its respective end 18C, 21C. Each arm 18, 21 also has a midpoint which is about halfway between the intermediate portion 15 and the respective end 18C, 21C (about half of the length). In one embodiment, the distal portion 18B, 21B of each arm 18, 21 is defined as the portion extending from the midpoint of each arm 18, 21 toward its end 18C, 21C. In another embodiment the distal portion 18B, 21B of each arm 18, 21 is defined as the portion beginning at each respective end 18C, 21C and extending about one-third of the length toward the intermediate portion 15.

Figure 3:
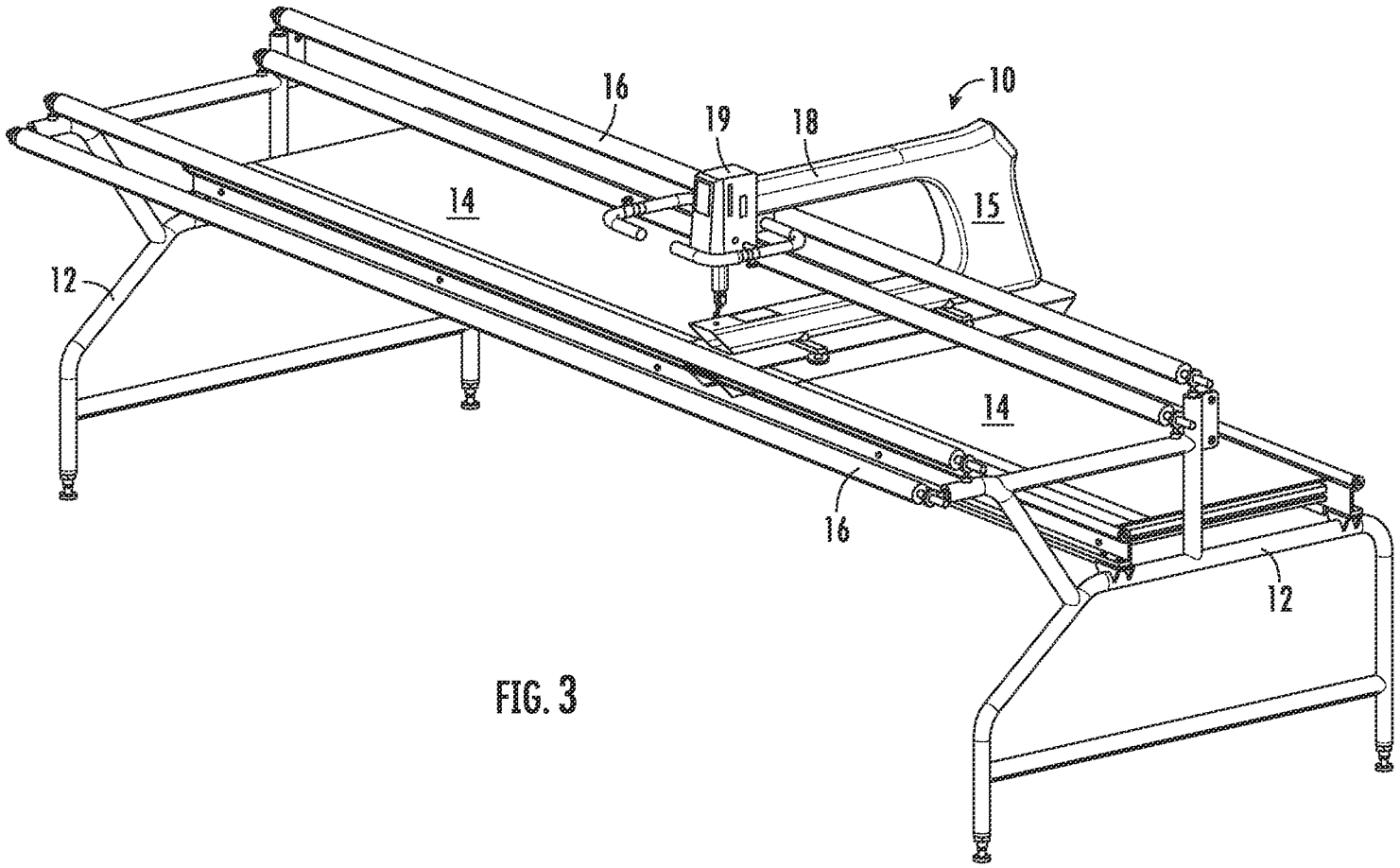
FIG. 3 is a perspective view of a longarming system.

FIG. 3 shows the longarm quilting machine 10 combined with a longarming system. The longarming system includes a quilting machine 10, a frame 12, a table 14, and several rollers 16 on which the fabric layers and batting are attached. The quilting machine 10 is movably attached to the frame 12 so the machine 10 moves in two dimensions along the length and width of the frame 12.

Figure 4:
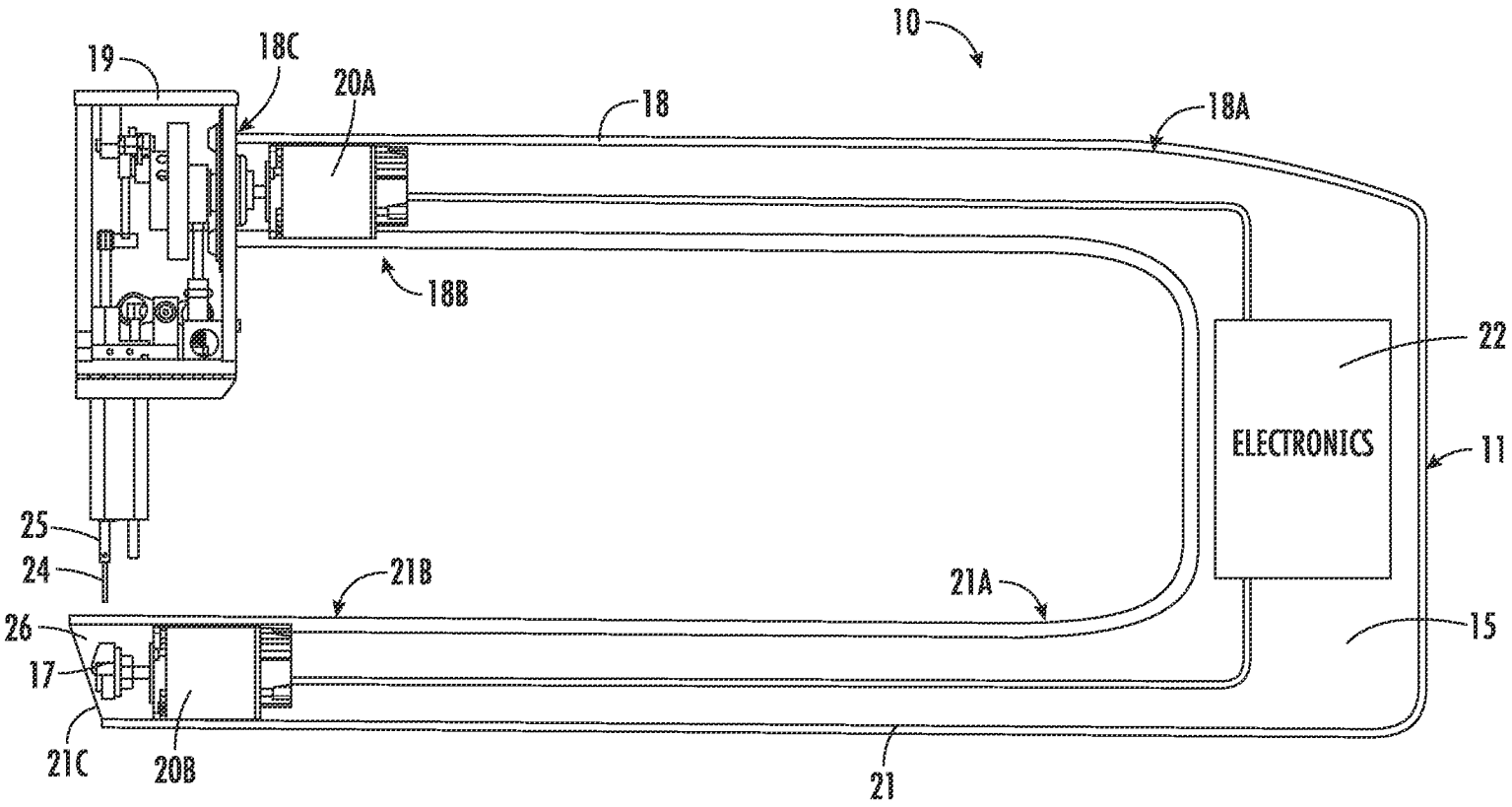
FIG. 4 is a section view of an embodiment of the quilting machine.

FIG. 4 is a section view of an embodiment of the quilting machine 10. A needle motor 20A is operatively combined with the needle bar drive mechanism 19 and configured to provide torque to the needle bar drive mechanism 19 to cause the needle 24 to move up and down. A bobbin motor 20B is operatively combined with the bobbin hook assembly 26 and configured to provide torque to the bobbin hook assembly 26 causing the bobbin 17 to rotate beneath the needle 24. The motors 20A, 20B are smart motors which enable determination of positions, speeds, and torque via a controller 22. The needle motor 20A and the bobbin motor 20B may be servo motors, stepper motors, or hybrid servo/stepper motors. In one embodiment each motor 20A, 20B is a hybrid servo/stepper motor configured to receive a command pulse stream from the controller 22 instructing the movement of each motor 20A, 20B, and the motors 20A, 20B are open loop such that they do not communicate directly with each other or they may be closed loop such that they do communicate with each other.

Figure 5:
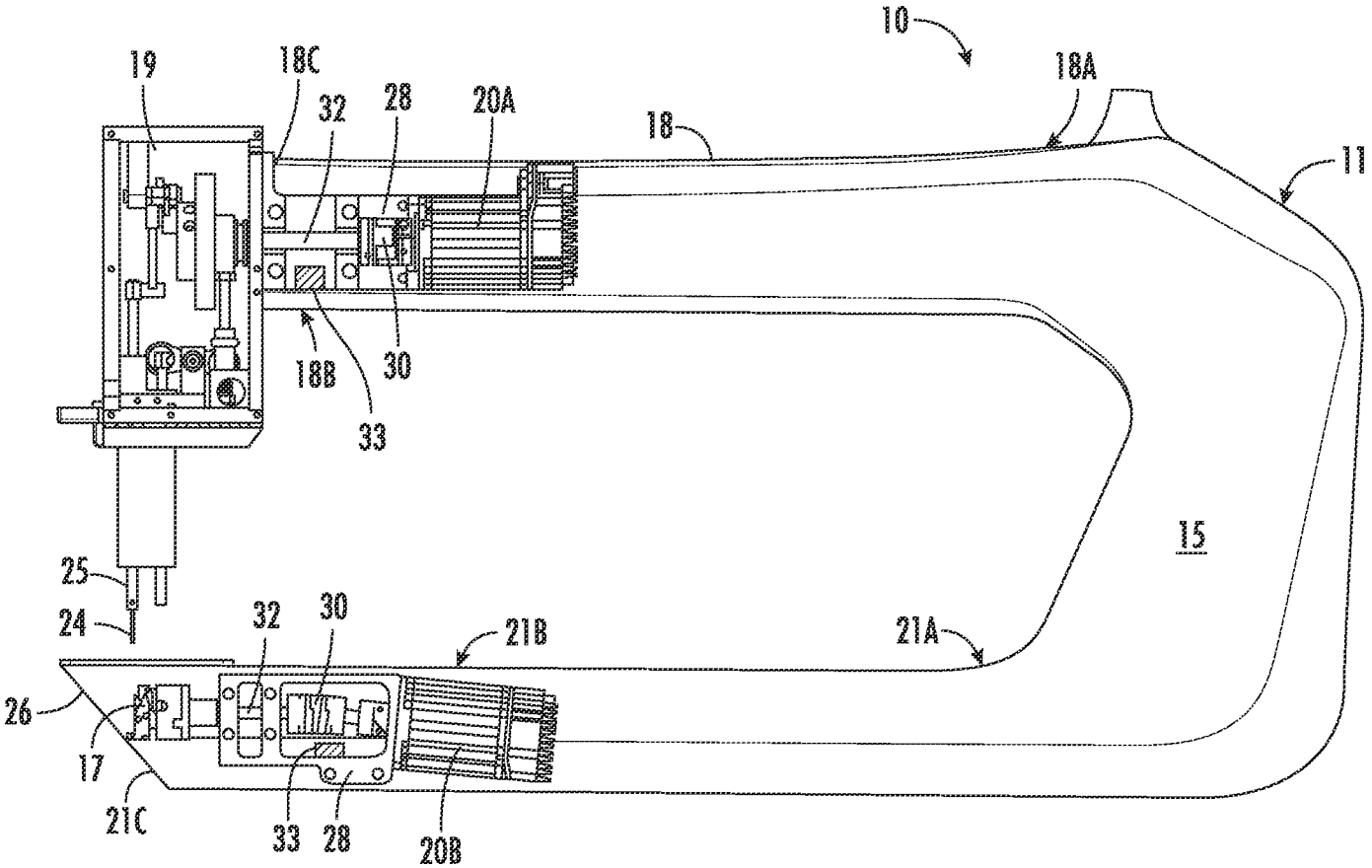
FIG. 5 is a section view showing another embodiment of the quilting machine.

FIG. 5 shows a section view of an alternate embodiment of a quilting machine 10 similar to the quilting machine 10 shown in FIG. 4. The embodiment shown in FIG. 5 includes several additional features, such as mounting blocks 28 configured to secure the motors 20A, 20B to the internal cavity of their respective arms 18, 21. The embodiment further includes internal shaft couplers 30 configured to attach the motors 20A, 20B to the drive shafts 32 connecting the needle motor 20A to the needle bar drive mechanism 19 and the bobbin motor 20B to the bobbin hook assembly 26.

In one embodiment, the needle motor 20A is positioned at the distal portion 18B of the upper arm 18 and the bobbin motor 20B is positioned at the distal portion 21B of the lower arm 21. In the embodiment shown, the motors 20A, 20B are positioned inside the respective cavities of the upper arm 18 and lower arm 21. Positioning the motors 20A, 20B near the ends 18C, 21C of the arms 18, 21 leaves the proximal portions 18A, 21A of the arms 18, 21 as well as the intermediate portion 15 of the frame 11 free from motors, belts, linkages, gears, and other mechanical drive components. Without internal mechanical drive components, the frame 11 and proximal portions 18A, 21A of the arms 18, 21 may be contoured to a wide variety of aesthetically pleasing shapes or configurations.

A controller 22, such as a circuit, processor, or servo controller, with control electronics is in communication with the needle motor 20A and the bobbin motor 20B. FIG. 4 shows the controller 22 positioned in the intermediate portion 15 of the frame 11, however, the controller 22 may be positioned in any other suitable location. For example, in the embodiment shown in FIG. 5 the controller 22 is the drive control circuitry integrated in the motors 20A, 20B. In one embodiment, one or more sensors 33 communicate rotational position information for each motor 20A, 20B to the controller 22. The sensors 33 determine whether each motor 20A, 20B (and their respective needle bar drive mechanism 24 and bobbin hook assembly 26) are in a particular position. In this manner the sensors 33 communicate rotation position data to the controller 22 and the controller 22 determines whether the components are synchronized.

In one embodiment the position of each motor 20A, 20B is determined every time the motor 20A, 20B (or any components being moved by the motor 20A, 20B, such as the drive shafts 32) passes a single predetermined rotational position, such as the UP position or the DOWN position. In this manner, the rotational position for each motor 20A, 20B is determined and compared once per stitch. In another embodiment rotational position information of each motor 20A, 20B (or related components) is determined at multiple predetermined positions, such as the UP position and the DOWN position, thereby allowing the system to determine synchronization of the motors 20A, 20B every half stitch. In yet another embodiment, the controller 22 is specially programmed to know the rotational position information of each motor 20A, 20B at all times such that a particular position of the needle motor 20A should always correspond to a particular position of the bobbin motor 20B. Regardless of the means and frequency of determining synchronization, if the controller 22 determines the motors 20A, 20B or their related components are not synchronized, the motors 20A, 20B are instructed to stop and/or the machine 10 turns OFF.

In one embodiment the sensors 33 are optical sensors configured to read the position of the motors 20A, 20B or one or more components being rotated by the motors 20A, 20B, such as the drive shafts 32. The rotating components (e.g., drive shafts 32) may include a collar having a band with one or more markers such as colored stripes or other visible indicators. The optical sensors 33 determine the position of the markers for each motor 20A, 20B at intervals (such as the UP and/or DOWN position as described previously) and sends a position signal to the controller 22 to determine whether the components are synchronized. In another embodiment the sensors 33 are magnetic sensors configured to read a magnetic collar combined with the rotating components (e.g., drive shafts 32).

It should be noted that in some embodiments the motors 20A, 20B do not rotate at the same speed. Instead, in some embodiments the bobbin motor 20B rotates twice as fast as the needle motor 20A. In these embodiments the controller 22 is programmed to correlate a single position of the bobbin motor 20B with multiple corresponding positions of the needle motor 20A to achieve synchronization. Further, it should be understood the positions of the motors 20A, 20B and related components discussed herein with respect to synchronization correspond to positions of the needle 24 and bobbin 17 as those components move relative to each other. The controller 22 uses position feedback to control the motion, speed, and position of each motor 20A, 20B.

Figure 6:
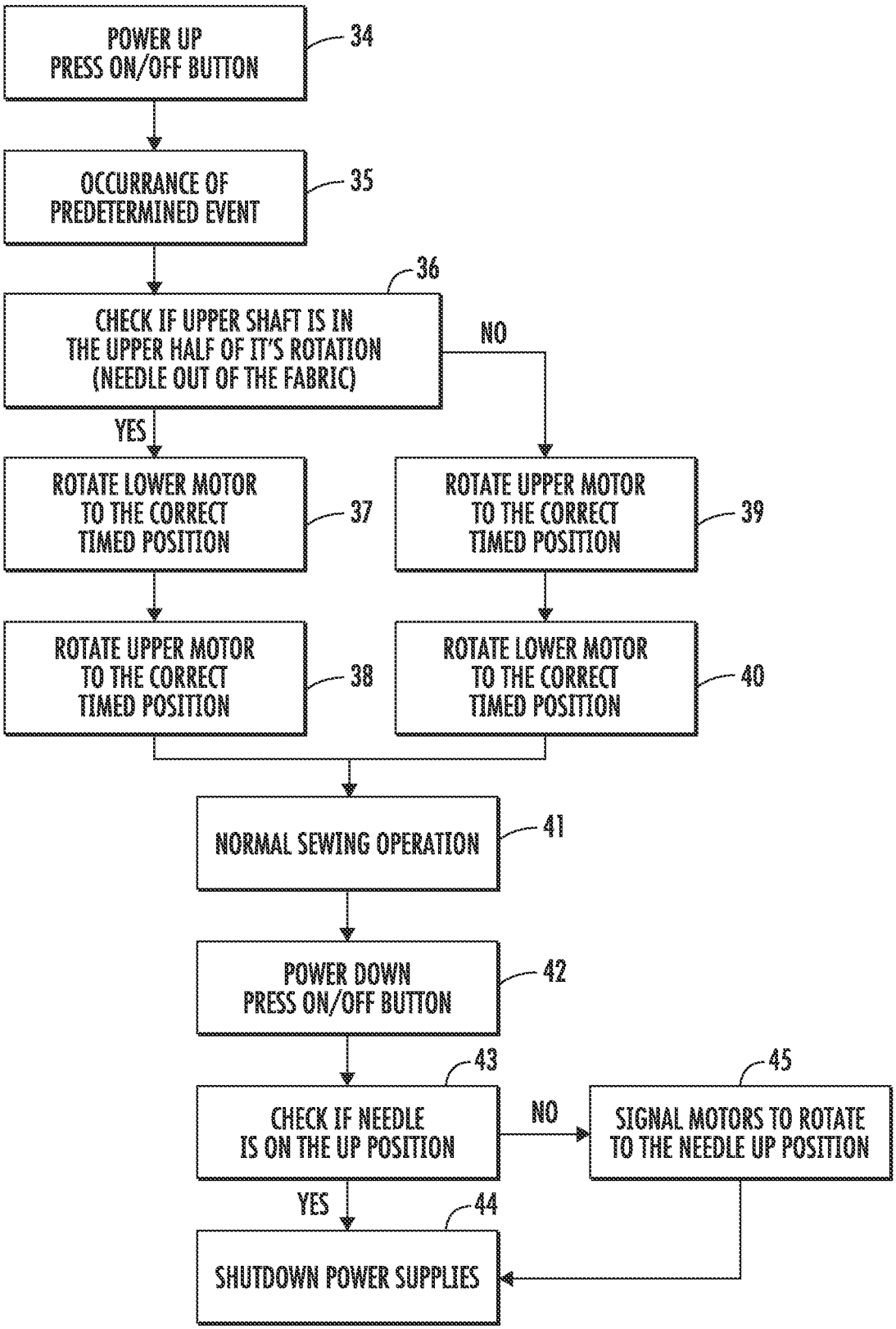
FIG. 6 is a logic flow chart showing an exemplary method of operation.

FIG. 6 is a logic flow chart showing an exemplary method of using the quilting machine 10 and the associated synchronization mode logic path followed by the controller 22 upon the occurrence of a predetermined event. The controller 22 monitors the operation of the machine 10 to determine when the machine 10 encounters a predetermined event, such as turning the power ON, pausing quilting operation for a predetermined amount of time, or determining the needle motor 20A and the bobbin motor 22B are not synchronized. In box 34 the machine is turned ON by a user and in box 35 the controller 22 receives power and proceeds to synchronization mode upon recognizing a predetermined event has occurred. In box 36 the controller 22 determines the position of the needle motor 20A to ensure the needle 24 is out of the bobbin hook assembly 27. Retracting the needle 24 from the bobbin hook assembly 27 helps prevent the needle 24 from being bent or broken when the bobbin 17 is being rotated to its home position. If the needle 24 is not out of the bobbin hook assembly 27, then the needle motor 20A is actuated until the needle 24 is moved out of the bobbin hook assembly 27. This is usually near the UP position, however, it may be any other position where the needle 17 is out of the bobbin hook assembly 27. Once the needle 17 is retracted from the bobbin hook assembly 27, the controller 22 sends a command to rotate the bobbin motor 20B to a predetermined home position (box 37), and then sends a command to rotate the needle motor 20A to a corresponding home position (box 38) wherein the needle 24 and bobbin 17 are synchronized. If the controller 22 determines the needle 24 is not out of the fabric in step 36, then the controller 22 first sends a command to rotate the needle motor 20A to a predetermined home position (box 39) and then the bobbin motor 20B to move the bobbin to a corresponding home position (box 40) wherein the needle 24 and bobbin 17 are synchronized. After synchronization mode is complete, the user begins normal sewing operation in box 41. While the machine 10 is turned ON and after the controller 22 has run the synchronization mode, the user cannot turn the shafts 32 of either motor 20A, 20B to help the motors 20A, 20B stay synchronized. When the user wants to turn the quilting machine 10 OFF, the user presses the power button in box 42. The controller 22 determines whether the needle motor 20A has the needle 24 in the up position (out of the fabric) (box 43). If so, the power supply is shut down (box 44). If not, the controller 22 sends a signal to the needle motor 20A to move the needle 24 to the up position (box 45) before shutting down power (box 44) to the quilting machine 10.

When the machine 10 is turned OFF, the controller 22 sends a frequency pulse to rotate the motors 20A, 20B to a predetermined position before turning the motors OFF. In the embodiment described above with respect to FIG. 6, the motors 20A, 20B are rotated to move the needle bar drive mechanism 19 to the UP position to ensure the needle 24 is not in the fabric so the user can remove the fabric from the quilting machine 10. In another embodiment, upon turning the machine 10 OFF, the motors 20A, 20B are rotated to move the needle bar drive mechanism 19 to the DOWN position to ensure the needle 24 remains in the fabric so the user can continue stitching from that exact point when the machine 10 is powered back ON.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included with in the scope of the following claims.

What is claimed is as follows:

1. A longarm quilting machine comprising:

a frame having an upper arm, a lower arm, and an intermediate portion connecting the upper arm to the lower arm, wherein the upper arm and the lower arm each have a proximal portion near the intermediate portion and a distal portion opposite the intermediate portion;

a needle bar drive mechanism configured to be combined with a needle and combined with a portion of the upper arm;

a bobbin hook assembly configured to be combined with a bobbin and combined with a portion of the lower arm;

a needle motor combined with the distal portion of the upper arm and operatively combined with the needle bar drive mechanism, said needle motor configured to provide torque to the needle bar drive mechanism causing movement of the needle;

a bobbin motor combined with the distal portion of the lower arm and operatively combined with the bobbin hook assembly, said bobbin motor configured to provide torque to the bobbin hook assembly causing movement of the bobbin;

wherein the needle motor and the bobbin motor each have a rotational position; and a controller configured to determine whether the needle motor and the bobbin motor are synchronized;

wherein the needle motor and the bobbin motor are each one of a servo motor, a stepper motor, and a servo/stepper hybrid motor a needle motor sensor comprising a first optical sensor configured to communicate position information about the rotational position of the needle motor to the controller and a bobbin motor sensor comprising a second optical sensor configured to communicate position information about the rotational position of the bobbin motor to the controller; and a first drive shaft configured to provide torque from the needle motor to the needle bar drive mechanism and a second drive shaft configured to provide torque from the bobbin motor to the bobbin hook assembly, wherein the first drive shaft has a first visible marker and the second drive shaft has a second visible marker, and wherein the needle motor sensor is configured to read a position of the first visible marker and communicate position information to the controller and the bobbin motor sensor is configured to read a position of the second visible marker and communicate position information to the controller.

2. The longarm quilting machine of claim 1 wherein the controller is configured to use position information to control the motion, speed, and position of the needle motor and the bobbin motor.

3. The longarm quilting machine of claim 1 wherein the controller is one of a circuit, a processor, and a servo controller.

4. The longarm quilting machine of claim 1 wherein the upper arm and the lower arm each have a length, a midpoint, and an end; and wherein the distal portion of the upper arm is between the upper arm midpoint and the upper arm end and the distal portion of the lower arm is between the lower arm midpoint and the lower arm end.

5. The longarm quilting machine of claim 1 wherein the upper arm and the lower arm each have a length, a midpoint, and an end; and wherein the distal portion of the upper arm is the portion beginning at the upper arm end and extending about one-third of the length toward the intermediate portion and the distal portion of the lower arm is the portion beginning at the lower arm end and extending about one-third of the length toward the intermediate portion.

6. The longarm quilting machine of claim 1 wherein the controller is configured to operate a synchronization mode upon the occurrence of a predetermined event, wherein the synchronization mode includes moving the bobbin motor to a predetermined home position and moving the needle motor to a predetermined home position.

7. The longarm quilting machine of claim 6 wherein a predetermined event is one of turning the power ON, pausing quilting operation for a predetermined amount of time, and determining the needle motor and the bobbin motor are not synchronized.

8. A longarm quilting machine comprising:

a frame having an upper arm, a lower arm, and an intermediate portion connecting the upper arm to the lower arm;

a needle bar drive mechanism configured to be combined with a needle carrier and combined with a portion of the upper arm;

a bobbin hook assembly configured to be combined with a bobbin and combined with a portion of the lower arm;

a needle hybrid servo/stepper motor having integrated drive circuitry, said needle hybrid servo/stepper motor combined with the upper arm and operatively combined with the needle bar drive mechanism, said needle hybrid servo/stepper motor configured to provide torque to the needle bar drive mechanism to cause movement of the needle carrier;

a bobbin hybrid servo/stepper motor having integrated drive circuitry, said bobbin hybrid servo/stepper motor combined with the lower arm and operatively combined with the bobbin hook assembly, said bobbin hybrid servo/stepper motor configured to provide torque to the bobbin hook assembly causing movement of the bobbin;

wherein the needle hybrid servo/stepper motor and the bobbin hybrid servo/stepper motor each have a rotational position;

a controller configured to determine whether the rotational position of the needle hybrid servo/stepper motor is synchronized with the rotation position of the bobbin hybrid servo/stepper motor; and a needle hybrid servo/stepper motor sensor configured to communicate the rotational position of the needle hybrid servo/stepper motor to the controller a bobbin hybrid servo/stepper motor sensor configured to communicate the rotational position of the bobbin hybrid servo/stepper motor to the controller; and a first drive shaft configured to provide torque from needle hybrid servo/stepper motor to the needle bar drive mechanism and a second drive shaft configured to provide torque from the bobbin hybrid servo/stepper motor to the bobbin hook assembly, wherein the first drive shaft has a first visible marker and the second drive shaft has a second visible marker, and wherein the needle motor sensor is configured communicate position information to the controller and the bobbin motor sensor is configured to communicate position information to the controller.

9. The longarm quilting machine of claim 8 wherein the needle hybrid servo/stepper motor sensor is an optical sensor and the bobbin servo/stepper motor sensor is an optical sensor.

10. The longarm quilting machine of claim 8 wherein the controller is configured to operate a synchronization mode upon the occurrence of a predetermined event, wherein the synchronization mode includes moving the bobbin motor to a predetermined home position and moving the needle motor to a predetermined home position.

11. The longarm quilting machine of claim 8 wherein the controller is part of the needle hybrid servo/stepper motor integrated drive circuitry and the bobbin hybrid servo/stepper motor integrated drive circuitry.

12. A method of operating a quilting machine, the quilting machine comprising a needle motor operatively combined with a needle bar drive mechanism having a needle carrier and a first optical marker, a bobbin motor operatively combined with a bobbin hook assembly, the bobbin hook assembly including a second optical marker, and a controller in communication with the needle motor and the bobbin motor, wherein the controller is configured to execute the method, the method comprising:

receiving rotational position information about the needle motor from a first optical sensor based on a position of the first optical marker;

receiving rotational position information about the bobbin motor from a second optical sensor based on a position of the second optical marker;

monitoring for the occurrence of a predetermined event; and synchronizing the needle motor and the bobbin motor upon the occurrence of a predetermined event by:

moving the bobbin motor to a bobbin motor home position; and moving the needle motor to a needle motor home position predetermined to be synchronized with the bobbin motor home position.

13. The method of claim 12 further comprising determining the position of the needle motor before synchronizing the needle motor and the bobbin motor, and moving the needle motor to retract the needle carrier upward away from the bobbin hook assembly before moving the bobbin motor to a bobbin motor home position.

14. The method of claim 12 further comprising determining the position of the needle motor upon receiving an instruction to turn the quilting machine OFF, and moving the needle motor to retract the needle carrier upward away from the bobbin hook assembly before turning the quilting machine OFF.

15. The method of claim 12 further comprising determining the position of the needle motor upon receiving an instruction to turn the quilting machine OFF, and moving the needle motor to extend the needle carrier downward toward the bobbin hook assembly before turning the quilting machine OFF.

* * * * *